United States Patent [19]

Oliver et al.

[11] 3,998,926

[45] Dec. 21, 1976

[54] TREATMENT OF MATERIAL WITH HYDROGEN CHLORIDE

[75] Inventors: Raymond Edward Oliver, Johannesburg, South Africa; George McGuire, London, England

[73] Assignee: Matthey Rustenburg Refiners (Pty) Ltd., Johannesburg, South Africa

[22] Filed: Mar. 18, 1975

[21] Appl. No.: 559,423

[30] Foreign Application Priority Data

Mar. 21, 1974 United Kingdom ..... 12598/74

[52] U.S. Cl. ..... 423/22; 423/44; 423/149; 75/83; 75/113; 423/88; 423/96; 423/97; 423/108

[51] Int. Cl.[2] ..... C01G 7/00; C01G 5/00; C01G 55/00

[58] Field of Search ..... 423/22, 44, 88, 96, 423/97, 108, 149; 75/112, 113, 83

[56] References Cited

UNITED STATES PATENTS

| | | | |
|---|---|---|---|
| 2,104,741 | 1/1938 | Fink | 75/113 |
| 3,049,422 | 8/1962 | Wolcott | 75/112 |
| 3,174,848 | 3/1965 | Bruce | 75/113 |
| 3,227,545 | 1/1966 | Hildreth | 75/112 |
| 3,615,202 | 10/1971 | Stern et al. | 423/613 |
| 3,694,168 | 9/1972 | Hilgers et al. | 423/613 |
| 3,802,873 | 4/1974 | Bradshaw | 75/113 |
| 3,825,651 | 7/1974 | Heinen et al. | 423/44 |
| 3,834,896 | 9/1974 | Eiseli et al. | 75/112 |
| 3,849,543 | 11/1974 | Zinigibl et al. | 423/592 |

*Primary Examiner*—Herbert T. Carter
*Attorney, Agent, or Firm*—Cushman, Darby & Cushman

[57] ABSTRACT

This invention relates to refining platinum group metal concentrates and the separation therefrom of silver and of the majority of base metals which are present with them. In more detail, the process comprises reacting together gaseous hydrogen and chlorine so as to produce a flame and passing into the reaction zone of the said flame the said mineral concentrate in finely divided particulate form.

The specification also describes an apparatus for carrying out the above process comprising a tubular burner having a hydrogen-chlorine flame discharging into an inner heat resistant tube and means for maintaining the inner tube at an elevated temperature up to at least 2500° C.

8 Claims, No Drawings

TREATMENT OF MATERIAL WITH HYDROGEN CHLORIDE

This invention relates to the refining of metal. In particular the invention is concerned with the refining of platinum group metal concentrates and the separation therefrom of silver and of the majority of the base metals which are present with them.

In this specification, by "precious metal" we mean gold and any one or more of the platinum group metals (that is, Ru, Rh, Pd, Os, Ir and Pt) and by "base metal" we mean any one or more metals other than silver, gold and the platinum group metals.

Material requiring refining may be a mixture containing precious metal, base metal and/or silver components either in metallic form or combined in the form of chemical compounds. It is an object of the present invention to provide a simple and effective refining process whereby a substantial proportion of the said silver and base metal components present in the said mixture are separated from the precious metal components and the concentration of the precious metal is thereby significantly increased. U.S. application Ser. No. 559,424, filed Mar. 18, 1975 there is described a process for the separation of components of base metal and silver from components of precious metal components in mineral concentrates which comprises the steps of:

a. contacting a solid particulate mixture of base, silver and precious metal components any of which components may be in metallic or chemically combined form, with a halogen-containing gas at a temperature which is sufficiently high for the base metal and silver components to form their halides and for the said halides substantially to volatilize from the said solid mixture and b. removing the said volatilized halides from the solid precious metal-containing component which remains Preferably the separation process of our earlier application includes a further step:

c. in which the solid precious metal-containing component remaining after step (b) is substantially dissolved in hydrochloric acid solution containing an oxidising agent.

Suitable oxidising agents which may be dissolved in the hydrochloric acid solution of step (c) are chlorine, bromine, hypochlorite, hypobromite, sodium chlorate and sodium bromate.

In the present invention, which is a modification and improvement on the above-described process, a process for the separation of components of both base metal and silver from precious metal components in mineral concentrates comprises reacting together gaseous hydrogen and chlorine so as to produce a flame and passing into the reaction zone of the said flame the said mineral concentrate in finely divided particulate form.

The combustion may be carried out in a suitably designed burner to which hydrogen gas and chlorine gas are fed, preferably at controlled rates, and the finely divided material may be carried to the burner in one or other or both of these gases. Alternatively or additionally, it may be fed to the burner in a stream of some diluent gas. The burner may be arranged in such a way either that hydrogen burns in chlorine or that chlorine burns in hydrogen.

One form of apparatus for carrying out the process of the present invention may comprise a concentric tube burner in which reacting constituents, having passed through the flame, discharge into a horizontal alumina or high alumina/silica tube. Such a tube is kept at as high a temperature as possible to minimise heat loss and prolong the effective reaction time.

The combustion of the hydrogen and chlorine produces a very high temperature, typically at least 1000° C and frequently much higher, to which, also, the finely divided mineral concentrate is exposed on passage through the flame. Preferably this temperature should be above 900° C and may, for example, fall within the range 1500°–2500° C.

Temperatures lower than that normally found in an undilated flame can be attained by introducing a preferably cold, and preferably inert, diluent gas into the mixture of gases and higher temperatures can be attained by preheating the hydrogen gas or chlorine gas or both before ignition.

Oxidising or reducing conditions at and near to the flame can be established by increasing or decreasing respectively the ratio of chlorine gas to hydrogen gas fed to the flame. These are suitably adjusted in response to the composition of the mineral concentrate. Passage of the powdered concentrate through the hydrogen chlorine flame results in the formation of volatile chloride of most of the silver present and volatile water soluble chlorides of most of the base metal present. These may be removed from the gas stream in a dry separator or a wet scrubber.

The water soluble components of the product may be leached therefrom by immersing the product in water and the precious metal containing insoluble concentrate which remains, is separated from the resulting base metal chloride solution by physical methods, e.g. filtration.

EXAMPLE

One way in which the present invention has been used for the treatment of a metal "concentrate" containing precious metal, base metal and/or silver in accordance with the method will now be disclosed.

Hydrogen was first caused to burn in chlorine by setting up an oxy-hydrogen flame at a burner consisting of two concentric tubes and introducing chlorine in progressively increasing quantities into the stream of oxygen being fed to the burner. At the same time the amount of this oxygen was progressively reduced until a chlorine-hydrogen flame was obtained. Next, the rates of supply of chlorine and hydrogen were both regulated to 15 liters per minute. Finally, the metal concentrate starting material ground sufficiently finely for it to pass a 200 mesh sieve was fed to the chlorine-hydrogen flame in the hydrogen stream passing along a venturi tube at 15 liters per minute. The product, carried by the stream of hydrogen chloride gas, was then scrubbed in water (which became acidic) and the solids filtered off and analysed.

These solids are found to be significantly richer in precious metal than the starting material as shown in the table below:

| | Starting Material wt. % | Product wt. % |
|---|---|---|
| Pt | 28.3 | 38.0 |
| Pd | 16.0 | 21.5 |

-continued

| | Starting Material wt. % | Product wt. % |
|---|---|---|
| Ir | 1.1 | 1.5 |
| Ru | 10.0 | 13.4 |
| Rh | 3.8 | 5.1 |
| Os | 0.3 | 0.4 |
| Au | 1.7 | 2.3 |
| Ag | 1.3 | 0.1 |
| Cu | 6.3 | 0.8 |
| Ni | 2.7 | 0.3 |
| Fe | 3.9 | 0.4 |
| Te | 2.1 | 0.3 |
| Se | 0.3 | less than 0.1 |
| Sb | 3.1 | 1.0 |
| Pb | 3.3 | 0.2 |
| S | 1.4 | less than 0.1 |
| Balance | 14.4 | 14.7 |

The "balance" of the composition of starting material consists mainly of non-metals with which some or all of the metallic components of the starting material are combined, together with one or more refractory oxides such as silica, alumina, titania and stannic oxide. The same applies to the "balance" of the composition of the product, except that here the proportion of refractory oxides which survives exposure to the hydrogen chloride is increased.

In the process according to the present invention, when the particulate solid is exposed to the flame of hydrogen and chlorine at elevated temperature practically all of the silver and all of the base metals such as Sb, Sn, Pb, Zn, Cu, Ni, Fe and Ac (but not all of the Se and Te) are converted to the chloride. However, at the temperature of operation of the process of the present invention the precious metal chlorides are not formed as stable compounds.

An advantage of the present invention is that treatment of the raw material concentrate with reacting $H_2$ and $Cl_2$ at elevated temperature renders the precious metal containing residue soluble in oxidising hydrochloric acid solution.

What we claim is:

1. A process for the separation of components of base metal and silver from precious metal components in mineral concentrates which comprises reacting together gaseous hydrogen and chlorine so as to produce a flame providing a reaction zone having a temperature within the range 900° to 2500° C, passing into the reaction zone of the said flame the said mineral concentrate in finely divided particulate form to obtain a reaction product wherein silver and base metal in said concentrate are converted to their volatile chlorides while the precious metal components in said concentrate remain in a solid, water-insoluble form and separating the silver and base metal chlorides from the water-insoluble solids in the reaction product, said base metal being selected from the group consisting of Sb, Sn, Pb, Zn, Cu, Ni, Fe and As.

2. A process according to claim 1 in which equimolar quantities of hydrogen and chlorine are reacted together.

3. A process according to claim 1 in which hydrogen burns in chlorine.

4. A process according to claim 1 in which chlorine burns in hydrogen.

5. A process according to claim 1 in which at least one of the reacting gases contains a diluent gas.

6. A process according to claim 1 in which the said temperature is within the range 1500°–2500° C.

7. A process according to claim 1 in which water soluble chlorides of base metals are leached from the reaction product by dissolution in water.

8. A process according to claim 7 in which the precious metal containing concentrate which remains is dissolved in hydrochloric acid containing an oxidising agent.

* * * * *